US008248346B2

(12) United States Patent
Kim et al.

(10) Patent No.: US 8,248,346 B2
(45) Date of Patent: Aug. 21, 2012

(54) LIQUID CRYSTAL DISPLAY AND DRIVING METHOD THEREOF

(75) Inventors: Sang-Uk Kim, Suwon-si (KR); Shawn Kim, Suwon-si (KR); Seong-Woock Hwang, Suwon-si (KR); In-Young Cho, Suwon-si (KR); Jeong-Min Park, Suwon-si (KR)

(73) Assignee: Samsung Mobile Display Co., Ltd., Nongseo-Dong, Giheung-Gu, Yongin, Gyunggi-Do (KR)

( * ) Notice: Subject to any disclaimer, the term of this patent is extended or adjusted under 35 U.S.C. 154(b) by 1037 days.

(21) Appl. No.: 12/222,052

(22) Filed: Jul. 31, 2008

(65) Prior Publication Data

US 2009/0128722 A1 May 21, 2009

(30) Foreign Application Priority Data

Nov. 16, 2007 (KR) ..... 10-2007-0117511

(51) Int. Cl.
*G09G 3/36* (2006.01)

(52) U.S. Cl. ..... 345/96; 345/87; 345/95; 345/209; 345/210; 345/690

(58) Field of Classification Search ..... 345/87–100, 345/204–215, 690
See application file for complete search history.

(56) References Cited

U.S. PATENT DOCUMENTS 7,728,804 B2 * 6/2010 Park et al. ..... 345/90
7,855,722 B2 * 12/2010 Kim et al. ..... 345/211
2004/0125066 A1 * 7/2004 Park et al. ..... 345/92
2007/0001978 A1 * 1/2007 Cho ..... 345/98
2007/0057887 A1 * 3/2007 Itakura et al. ..... 345/90

FOREIGN PATENT DOCUMENTS

KR 1998-072530 11/1998
KR 2002-0028374 A 4/2002
KR 10-2006-0071121 6/2006
KR 10-2006-0094386 8/2006
KR 2007-0097635 A 10/2007

OTHER PUBLICATIONS

Korean Office Action issued by KIPO in corresponding Korean Patent Application No. 2007-0117511 on Dec. 10, 2008.

* cited by examiner

*Primary Examiner* — Vijay Shankar
(74) *Attorney, Agent, or Firm* — Robert E. Bushnell, Esq.

(57) ABSTRACT

Disclosed is a liquid crystal display including a liquid crystal panel that includes a plurality of liquid crystal cells for controlling light transmission, a common electrode driving circuit for providing a common voltage signal to a common electrode provided in the liquid crystal panel and a first signal driving circuit for providing a first signal to a transparent electrode provided in the liquid crystal panel. The first signal and the common voltage signal have the same frequency and amplitude, but are out of phase with each other. The transparent electrode is designed to cancel an acoustic noise generated by the application of the common voltage signal. The liquid crystal panel includes two substrates that face each other. In one embodiment, the common electrode and the transparent electrode are formed in the same substrate, and in another embodiment, the common electrode and the transparent electrode are formed in different substrates.

5 Claims, 4 Drawing Sheets

LIQUID CRYSTAL DISPLAY AND DRIVING METHOD THEREOF

CLAIM OF PRIORITY

This application makes reference to, incorporates the same herein, and claims all benefits accruing under 35 U.S.C. §119 from an application for *LIQUID CRYSTAL DISPLAY AND DRIVING METHOD THEREOF* earlier filed in the Korean Intellectual Property Office on the 16 of Nov. 2007 and there duly assigned Serial No. 10-2007-0117511.

BACKGROUND OF THE INVENTION

1. Field of the Invention

The present invention relates to a liquid crystal display and a driving method thereof, and more particularly, to a liquid crystal display in which acoustic noise, which is caused by common voltage signals driven in a form of alternating current (AC), is removed and a driving method thereof.

2. Description of the Related Art

As information oriented society has been developed, demands for displays for displaying an image are increasing. Thus, various flat displays such as a liquid crystal display (LCD), a plasma display panel (PDP), and organic light emitting display (OLED), and a vacuum fluorescent display (VFD) have been used recently.

The LCD among the flat displays is generally implemented in an active matrix type using thin film transistor (TFT) devices. The LCD is widely used now because of the advantage of a small size and thickness, light weight, and low power consumption.

The LCD includes two substrates facing each other and a liquid crystal disposed between the two substrates. The LCD displays an image by changing arrangement of the liquid crystal by an electric field generated between a pixel electrode and a common electrode that are formed on the two substrates.

As shown in FIG. 1, a liquid crystal panel 51 includes a first substrate 52 and a second substrate 53 that face each other, and a liquid crystal 54 interposed between the substrates 52 and 53. In the first substrate 52, TFTs and pixel electrodes are formed. In the second substrate 53, a color filter and the common electrode are formed.

The liquid crystal panel 51 has liquid crystal cells (pixels) that are regions defined by scan lines and data lines, and the pixels are disposed in a form of a matrix (two-dimensional array). The reorientations of molecules of the liquid crystal are controlled in every liquid crystal cells so that the image is displayed in the liquid crystal panel 51.

The reorientations of the liquid crystal molecules within the liquid crystal cells are controlled by a voltage applied between an electrode formed in the second substrate 53 (a common electrode) and pixel electrodes of the first substrate 52. The application of the voltage is controlled by turning on/off the TFT that is formed in each of the liquid crystal cells.

Moreover, the LCD is driven considering reliability of the liquid crystal material, that is, to prevent deterioration of the liquid crystal material. An alternating current (AC) type voltage signal, in which polarity of voltage alternates with time, is applied to the liquid crystal material, which is formed in each of the pixels, for every time periods.

For the methods of driving the LCD using the AC type voltage signals, there are a line reversing method, a source reversing method, and a dot reversing method. Among the methods, the line reversing method reverses the polarities every low lines on the panel to apply an image signal to the respective liquid crystal cells.

That is, the line reversing method, for example, as shown in FIG. 2, is configured to reverse the polarities of the voltage applied to the liquid crystal cells by varying a voltage (depicted by a solid line in FIG. 2) applied to the common electrode by one horizontal period 1H and a voltage (depicted by a dotted line in FIG. 2) of the image signal applied to the liquid crystal cells.

As such, when the liquid crystal is driven by the AC drive, signals with inverse phases to each other are applied to a pair of electrodes (common electrode and pixel electrode) and a voltage (bias) is applied between the electrodes.

Therefore, the LCD is driven by the line inverse method so that the second substrate 53 in which the common electrode is formed vibrates in accordance with the application of the voltage to the common electrode.

At this time, since a drive frequency of the common electrode (a frequency of a voltage applied to the common electrode) is about 10 kHz at a liquid crystal panel for a current portable device, the second substrate 53 vibrates at about 10 kHz when driving the LCD.

Since the vibration has a frequency within an audio frequency band of human being (20 Hz to 20 kHz), the vibration is recognized by a user as sound to be harsh to the ear, that is, a noise. Such noise is seriously rising as a series problem as a thickness of a portable device employing the LCD becomes thin and a distance between the LCD and the portable device is being narrow.

SUMMARY OF THE INVENTION

Accordingly, it is an aspect of the present invention to provide a liquid crystal display for removing an audible noise generated by a drive frequency of a common electrode in a liquid crystal display driven by a line reverse method and a driving method thereof.

The objects and/or other aspects of the present invention will be described in the description of the preferred embodiments of the present invention and the following claims. The foregoing and/or other aspects of the present invention are achieved by providing a liquid crystal display including: a liquid crystal panel including a plurality of liquid crystal cells for controlling light transmission, a common electrode driving circuit for providing a common voltage signal to the liquid crystal panel; and a first signal driving circuit for providing a first signal to the liquid crystal panel. The first signal has the same frequency and amplitude as the common voltage signal, and the first signal and the common voltage signal are out of phase with each other.

The liquid crystal panel may include a first substrate, a plurality of gate lines and data lines disposed in the first substrate, a plurality of switching devices formed in the first substrate, each of which is coupled to one of the gate lines and one of the data lines, a plurality of pixel electrodes formed in the first substrate, each of which is coupled with one of the switching devices, a second substrate facing the first substrate, a common electrode formed on an inner surface of the second substrate that faces the first substrate, color filters formed in the second substrate, each of which is aligned with one of the pixel electrodes, a transparent electrode formed on an outer surface of the second substrate, and a liquid crystal layer disposed between the first and second substrates.

The liquid crystal panel may include a first substrate, a plurality of gate lines and data lines disposed in the first substrate, a plurality of switching devices formed in the first substrate, each of which is coupled to one of the gate lines and one of the data lines, a plurality of pixel electrodes formed in the first substrate, each of which is coupled with one of the switching devices, a common electrode formed between two of the pixel electrodes, a second substrate facing the first substrate, color filters formed in the second substrate, each of which is aligned with one of the pixel electrodes, a transparent electrode formed on an outer surface of the second substrate that does not face the first substrate, and a liquid crystal layer disposed between the first and second substrates.

The foregoing and/or other aspects of the present invention are achieved by providing a driving method of a liquid crystal panel that includes steps of applying a voltage signal, a polarity of which alternates, to pixel electrodes included in the liquid crystal panel, applying a common voltage signal, a polarity of which alternates, to a common electrode included in the liquid crystal panel, and applying a first signal to a transparent electrode included in the liquid crystal panel whenever the common voltage signal is applied to the common electrode. The common voltage signal and the voltage signal are out of phase. The first signal has the same frequency and amplitude as the common voltage signal, and the first signal and the common voltage signal are out of phase with each other.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
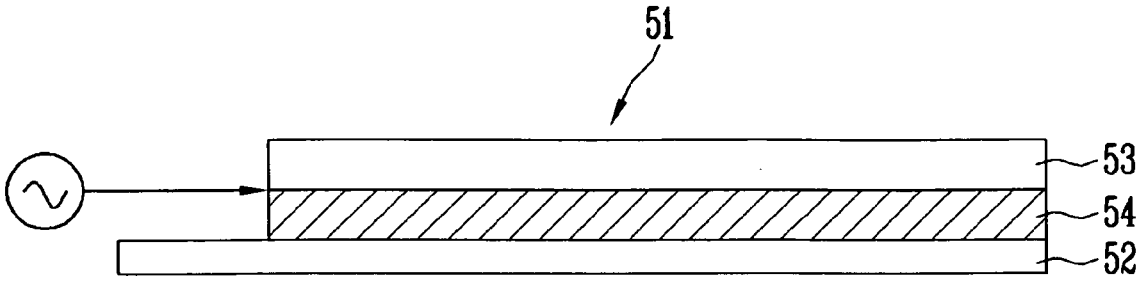
FIG. 1 (RELATED ART)
FIG. 1 is a schematic sectional view illustrating a liquid crystal panel provided in a conventional liquid crystal display.
Figure 2:
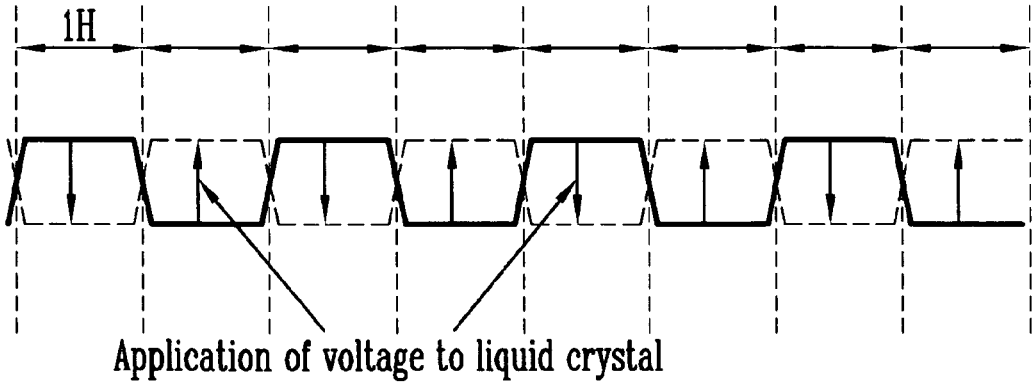
FIG. 2 (RELATED ART)
FIG. 2 is a waveform chart illustrating driving timings of a common electrode and a pixel electrode in a conventional line reverse method.

Hereinafter, certain exemplary embodiment according to the present invention will be described with reference to the accompanying drawings. Here, when a first element is described as being coupled to a second element, the first element may be not only directly coupled to the second element but may also be indirectly coupled to the second element via a third element. Further, elements that are not essential to the complete understanding of the invention are omitted for clarity. Also, like reference numerals refer to like elements throughout.

Figure 3:
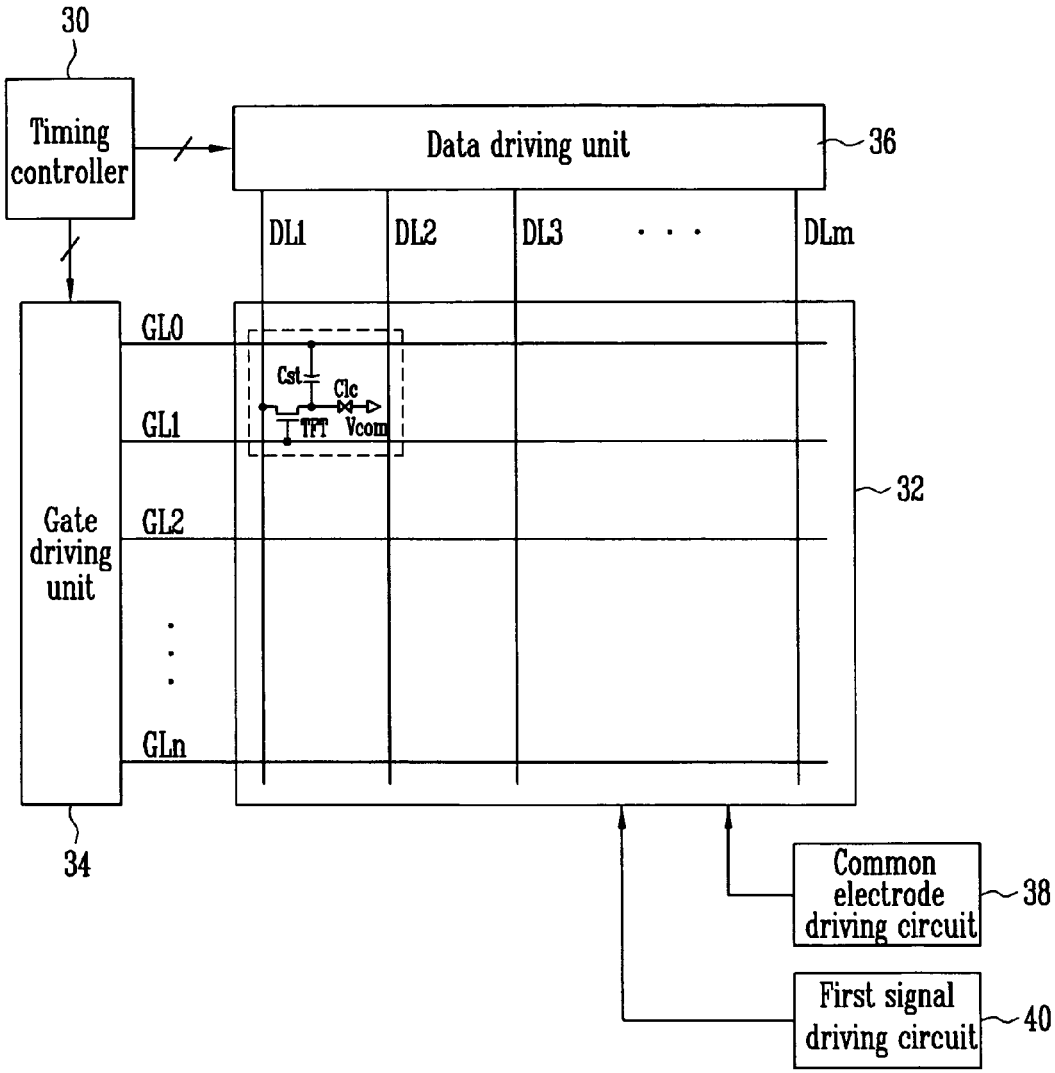
FIG. 3 is a block diagram illustrating a structure of a liquid crystal display panel according to an embodiment of the present invention.

FIG. 3 is a block diagram illustrating a structure of a liquid crystal display according to an embodiment of the present invention.

As illustrated in FIG. 3, the LCD according to an embodiment of the present invention includes a liquid crystal panel 32 in which liquid crystal cells are arranged in the form of a matrix, a gate driving unit 34 for driving gate lines GL0 to GLn of the liquid crystal panel 32, a data driving unit 36 for driving data lines DL1 to DLm of the liquid crystal panel 32, and a timing controller 30 for controlling the gate driving unit 34 and the data driving unit 36.

Moreover, the LCD according to the embodiment of the present invention further includes a common electrode driving circuit 38 for providing a common voltage with a predetermined drive frequency to a common electrode that is provided in the liquid crystal panel 32, and a first driving circuit 40 for providing a first signal to a transparent electrode that is provided in the liquid crystal panel 32.

In this case, the first signal has the same frequency and amplitude as the common voltage, but has a phase opposite to that of the common voltage applied to the common electrode. In other words, the common voltage and the first signal are out of phase with each other. The first signal is applied simultaneously with the application of the common voltage in order to remove audio frequency that is generated by the driving frequency of the common voltage.

It is clear to those skilled in the art that the common electrode driving circuit 38 and the first signal driving circuit 40 are integrated into a single driving circuit.

The liquid crystal panel 32 includes liquid crystal cells arranged in the form of a matrix and thin film transistors TFT formed at every intersection between the gate lines GL0 to GLn and the data lines DL1 to DLm and respectively coupled with the liquid crystal cells.

The TFTs are turned on by a scan signal (for example, a gate high voltage VGH) generated from the gate driving unit 34 and applied to the gate line GL of the liquid crystal panel 32. Due to this, the TFTs supply the data signal applied from the data driving unit 36 and supplied to the data line DL of the liquid crystal panel 32.

Moreover, when a gate low voltage VGL is supplied from the gate line GL, the TFTs are turned off. Due to this, the data signal charged in the liquid crystal cells is maintained. Each of the liquid crystal cells is equivalently represented by a liquid crystal capacitor CLC. The liquid crystal cell includes a common electrode Vcom and a pixel electrode facing each other, and a liquid crystal interposed between the common electrode and the pixel electrode. The pixel electrode is coupled with the TFT.

The liquid crystal cells further include storage capacitors Cst such that the charged data signal is steadily maintained until the next data signal is applied. The orientation of anisotropic liquid crystals varies according to the voltage of the data signal applied to the liquid crystal cells, and light transmission depends on the orientation of the liquid crystals so that gray scale is achieved by changing the voltage.

In this case, the data signal expressed by a predetermined voltage is applied to the pixel electrode and the common voltage is applied to the common electrode.

The LCD is driven by the AC type voltage signals having alternating polarity of voltages that are applied to the respective pixels at every period in order to maintain reliability of liquid crystal material. In the line reverse method among the driving methods of the LCD by the AC driving, the polarities are reversed at every row line of the liquid crystal panel 32 so that the image signals are applied to the respective liquid crystal cells.

By doing so, in the LCD driven by the line reverse method, the common voltage that is applied to the common electrode has a predetermined frequency. Because of the AC type driving, vibration is generated in the substrate in which the common electrode is formed. Since the vibration, as described above, has a frequency within the human audio frequency band (20 Hz to 20 kHz), a user recognizes the vibration as a sound, which is a noise to the user.

In the present invention, in order to overcome the above-mentioned problem, a transparent electrode is formed on a surface of the substrate that is opposite to a surface of the substrate in which the common electrode is formed. A first signal, having the same frequency and amplitude as the common voltage signal and a phase opposite to that of the common voltage applied to the common electrode, is applied to the transparent electrode. By doing so, the present invention is characterized in that the audible noise generated by the driving frequency of the common voltage is removed.

Figure 4:
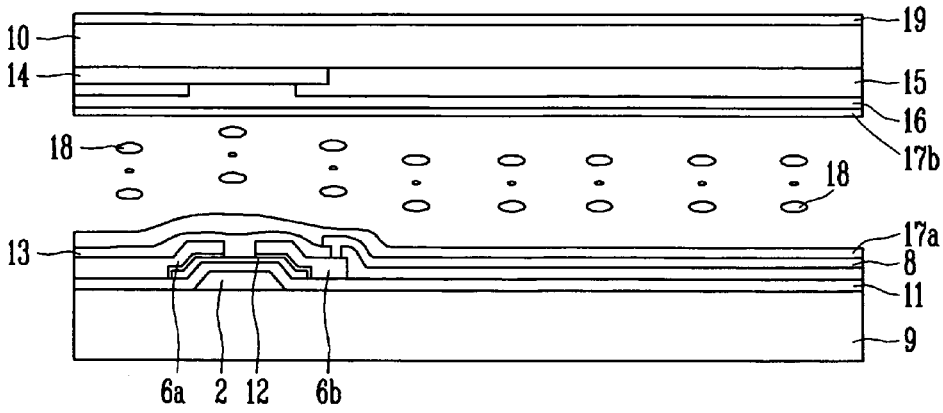
FIG. 4 is a sectional view according to a first embodiment of the present invention illustrating a liquid crystal panel in FIG. 3.

FIG. 4 is a sectional view according to a first embodiment of the present invention illustrating a liquid crystal panel in FIG. 3. Referring to FIG. 4, a liquid crystal panel includes a gate line (not shown) and a gate electrode 2 that are formed on a first substrate 9, a gate insulating layer 11, a semiconductor layer 12, source/drain electrodes 6*a* and 6*b*, a data line (not shown), a protecting layer 13, a pixel electrode 8, and a first orientation film 17*a*.

The gate line is formed on the first substrate 9 in one direction. The gate electrode 2 protrudes from the gate line. The gate insulating layer 11 is formed on the surface of the first substrate 9, and covers the gate electrode 2. The semiconductor layer 12 is formed on the gate insulating layer 11 above the gate electrode 2. The source/drain electrodes 6*a* and 6*b* are formed by disposing ohmic contact layers on both sides of the semiconductor layer 12. The data line (not shown) is coupled with any one of the source/drain electrodes 6*a* and 6*b*. The protecting layer 13 has a contact hole (not shown) in the drain electrode 6*b* and is formed on the first substrate 9. The pixel electrode 8 is formed on the protecting layer 13 to be electrically coupled with the drain electrode 6*b* through the contact hole. The first orientation film 17*a* is formed on the pixel electrode 8.

In this case, the gate electrode 2, the gate insulating layer 11, the semiconductor layer 12, and the source/drain electrodes 6*a* and 6*b* form a thin film transistor TFT.

The liquid crystal panel further includes a black matrix 14 formed on a second substrate 10 facing the first substrate 9, a color filter 15, a common electrode 16, and a second orientation film 17*b*.

The black matrix 14 prevents light from leaking to the gate line, the data line, and the TFT. The color filter is provided to produce red (R), green (G), and blue (B) colors, and is positioned in a location on which the black matrix 14 is not formed. The common electrode 16 is formed on the color filter 15. The second orientation film 17*b* is formed on the common electrode 16. A liquid crystal layer 18 is formed between the two substrates 9 and 10. In the liquid crystal panel according to the embodiment of FIG. 4, the pixel electrode 8 and the common electrode 16 are formed on different substrates.

As described above, a predetermined voltage corresponding to the data signal is applied to the pixel electrode 8, and a common voltage is applied to the common electrode 16. However, when it is assumed that the LCD is driven by the line reverse method, the common voltage has a predetermined drive frequency. Due to this, vibration is produced in the second substrate 10 in which the common electrode is formed, and is recognized as a noise by the user.

In order to overcome this problem, in this embodiment of the present invention, a transparent electrode 19 is further formed on an upper (or outer) surface of the second substrate 10, while the common electrode 16 is formed on a lower (or inner) surface of the second substrate 10. A first signal, which has the same frequency and amplitude as the common voltage and has a phase opposite to the phase of the common voltage, is applied to the transparent electrode 19. The application of the first signal removes the audio frequency noise generated by the driving frequency of the common electrode. In other words, the vibration of the second substrate 10 caused by the application of the common voltage is canceled with the vibration having an opposite phase, which is caused by the first signal applied to the transparent electrode 19 so that the audio noise can be removed.

However, in the above embodiment, the transparent electrode 19 should be further formed on the front side of the second substrate 10 in order to remove the audio noise.

An LCD, in which the common electrode 16 and the pixel electrode 8 are formed on different substrates, is driven by applying electric field between the substrates. The LCD having the above-mentioned structure is excellent in the characteristics of transmittance and aperture ratio, and prevents the liquid crystal cell from being damaged due to static electricity. However, this type of liquid crystal panel by nature has a narrower viewing angle. In order to overcome the above-mentioned shortcoming, an in-plane switching (IPS) mode liquid crystal display is proposed. The IPS mode LCD is characterized in that a pixel electrode and a common electrode are formed on the same plane of a first substrate so that the IPS mode LCD is driven by electric field between the pixel electrode and the common electrode.

The structure of a liquid crystal of the IPS mode LCD will be described referring to a second embodiment illustrated in FIG. 5.

Figure 5:
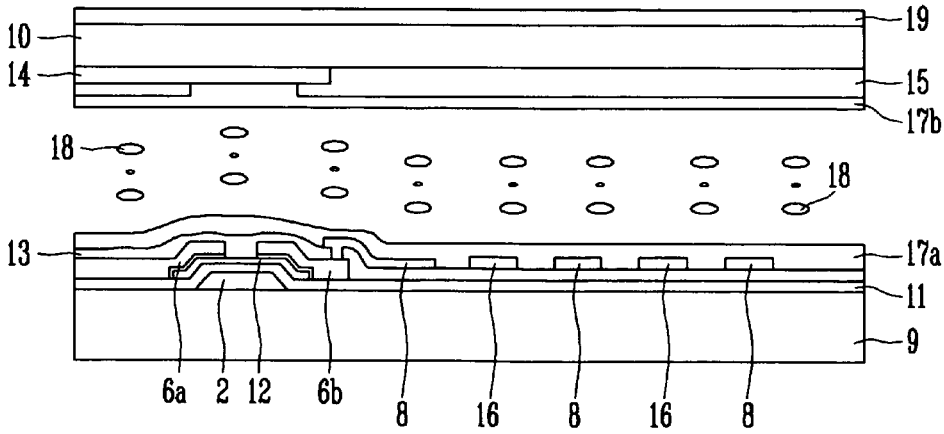
FIG. 5 is a sectional view according to a second embodiment of the present invention illustrating a liquid crystal panel in FIG. 3.

Referring to FIG. 5, a liquid crystal includes a gate line (not shown), a gate electrode 2, a gate insulating layer 11, a semiconductor layer 12, source/drain electrodes 6*a* and 6*b*, a data line (not shown), a protecting layer 13, a pixel electrode 8, a common electrode 16, and a first orientation film 17*a*.

The gate line (not shown) is formed on the first substrate 9 in one direction. The gate electrode 2 protrudes from the gate line. The gate insulating layer 11 is formed on the front surface of the first substrate 9 and covers the gate electrode 2. The semiconductor layer 12 is formed on the gate insulating layer 11 above the gate electrode 2. The source/drain electrodes 6*a* and 6*b* are formed by disposing ohmic contact layers on both sides of the semiconductor layer 12. The data line is coupled with any one of the source/drain electrodes 6*a* and 6*b*. The protecting layer 13 has a contact hole (not shown) in the drain electrode 6*b* and is formed on the first substrate 9. The pixel electrode 8 is formed on the protecting layer 13 to be electrically coupled with the drain electrode 6*b* through the contact hole. The common electrode 16 alternates with the pixel electrode 6. The first orientation film 17*a* is formed on the pixel electrode 8 and the common electrode 16.

In this case, a plurality of pixel electrodes 8 and common electrodes 16 is formed within a single cell region such that the plurality of the pixel electrodes 8 and common electrodes 16 respectively receive the data signal and the common voltage.

Therefore, in the cell region, transversal electric field is distributed by voltages applied to the pixel electrodes 8 and the common electrodes 16. The gray scale is achieved by adjusting light transmittance by changing the arrangement of liquid crystals that changes based on strength of the electric field.

However, the pixel electrode 8 and the common electrode 16 may be formed on the same layer as those of the gate electrode 2 or the source/drain electrodes 6*a* and 6*b*, and on different layers by interposing the gate insulating layer 11 or the protecting layer 13 therebetween.

In this case, the gate electrode 2, the gate insulating layer 11, the semiconductor layer 12, and the source/drain electrodes 6*a* and 6*b* constitute a thin film transistor (TFT).

The liquid crystal cell further includes a black matrix 14 formed on a second substrate 10 facing the first substrate 9, a color filter 15, and a second orientation film 17*b*. The black matrix 14 prevents light from leaking to the gate line, the data line, and the TFT. The color filter 15 is provided to produce red (R), green (G), and blue (B) colors and is positioned on a location in which the black matrix 14 is not formed. The second orientation film 17*b* is formed on the common electrode 16. A liquid crystal layer 18 is formed between the two substrates.

The liquid crystal panel of the embodiment of FIG. 5, which is different from the embodiment of FIG. 4, is characterized in that the pixel electrode 8 and the common electrode 16 are formed on the same substrate (first substrate 9). However, in a case of the IPS mode LCD according to the second embodiment of the present invention, in order to prevent the static electricity from being generated, a transparent electrode 19 is formed on the upper surface of the second substrate 10.

When the IPS mode liquid crystal cell is driven by the line reverse method, the common voltage has a predetermined driving frequency. Due to this, the first substrate 9, in which the common electrode 16 is formed, vibrates and this vibration is recognized as a noise by a user.

In order to overcome the shortcoming, in this embodiment of the present invention, a first signal, having the same frequency and amplitude as the common voltage and a phase opposite to that of the common voltage that is applied to the common electrode 16, is applied to the transparent electrode 19 formed on the upper surface of the second substrate 10 for the purpose of preventing the static electricity.

The application of the first signal removes the audio frequency generated by the drive frequency of the common voltage. Because the first and second substrates 9 and 10 are bonded to each other by a sealant (not shown), the vibration of the first substrate 9 caused by the application of the common voltage is canceled with the vibration of the second substrate 10 with an opposite phase caused by the first signal applied to the transparent electrode 19. Due to this, the audio noise can be removed.

In other words, according to the embodiment of FIG. 5, since there is no necessary for further forming the transparent electrode 19 on the front side of the second substrate 10 for the removal of the audio noise, the shortcoming of adding a process can be overcome.

The removal of the noise, as described with reference to FIGS. 4 and 5, generated by the common electrode due to the signals that are applied to the common electrode and the transparent electrode will be described in detail with reference to FIG. 6.

Figure 6:
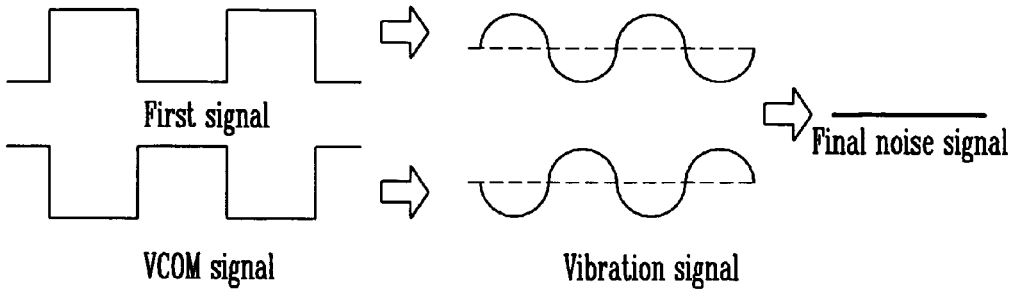
FIG. 6 is a view illustrating a driving method of a liquid crystal display according to an embodiment of the present invention.

FIG. 6 shows a waveform of the common voltage applied to the common electrode, and a waveform of a first signal applied to the transparent electrode. The first signal has the same frequency and amplitude as the common voltage and has a phase opposite to that of the common voltage. The first signal is applied to the transparent electrode simultaneously with the common voltage applied to the common electrode. As described above, a predetermined vibration signal is generated as illustrated by the common voltage with the predetermined frequency.

This embodiment of the present invention is characterized in that the first signal is applied to the transparent electrode corresponding to the common electrode a vibration signal with a reverse phase such that the vibration signal can be canceled with a predetermined vibration signal generated by the common voltage.

A noise signal finally generated by the above-mentioned operation is removed by the cancel between the vibrations. In other words, the first signal having the same frequency and amplitude as those of and the phase reverse to that of the common voltage is applied together with the common voltage so that the vibration frequencies generated by being synchronized to the respective phases are canceled with each other. Due to this, the audio noise can be removed.

According to the present invention, the audio noise generated by the drive frequency of the common electrode can be removed and a portable device employing the LCD can be thinner.

Although exemplary embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A method for driving a liquid crystal panel comprising:

applying a voltage signal, a polarity of which alternates, to pixel electrodes included in the liquid crystal panel, the voltage signal being applied to liquid crystal cells of the liquid crystal panel to control light transmission, the voltage signal being supplied from a data driving unit;

applying a common voltage signal, a polarity of which alternates, to a common electrode included in the liquid crystal panel, the common voltage signal and the voltage signal being out of phase, the common voltage signal being supplied from a common electrode driving circuit; and applying a first signal to a transparent electrode included in the liquid crystal panel whenever the common voltage signal is applied to the common electrode, the first signal having the same frequency and amplitude as the common voltage signal, the first signal and the common voltage signal being out of phase with each other, the first signal being supplied from a first signal driving circuit, wherein the liquid crystal panel comprises:

a first substrate, the pixel electrodes formed in the first substrate, the common electrode formed between two of the pixel electrodes;

a plurality of gate lines and data lines disposed in the first substrate;

a plurality of switching devices formed in the first substrate, each of the switching devices being coupled to one of the gate lines and one of the data lines, each of the pixel electrodes being coupled with one of the switching devices;

a second substrate facing the first substrate, the transparent electrode formed on an outer surface of the second substrate that does not face the first substrate;

color filters formed in the second substrate, each of the color filters aligned with one of the pixel electrodes; and a liquid crystal layer disposed between the first and second substrates.

2. A method for driving a liquid crystal panel comprising:

applying a voltage signal, a polarity of which alternates, to pixel electrodes included in the liquid crystal panel the voltage signal being applied to liquid crystal cells of the liquid crystal panel to control light transmission, the voltage signal being supplied from a data driving unit;

applying a common voltage signal, a polarity of which alternates, to a common electrode included in the liquid crystal panel, the common voltage signal and the voltage signal being out of phase, the common voltage signal being supplied from a common electrode driving circuit; and applying a first signal to a transparent electrode included in the liquid crystal panel whenever the common voltage signal is applied to the common electrode, the first signal having the same frequency and amplitude as the common voltage signal, the first signal and the common voltage signal being out of phase with each other, the first signal being supplied from a first signal driving circuit, wherein the liquid crystal panel comprises:

a first substrate including the pixel electrodes;

a plurality of gate lines and data lines disposed in the first substrate;

a plurality of switching devices formed in the first substrate, each of the switching devices being coupled to one of the gate lines and one of the data lines, each of the pixel electrodes being coupled with one of the switching devices;

a second substrate facing the first substrate, the common electrode formed on an inner surface of the second substrate that faces the first substrate, the transparent electrode formed on an outer surface of the second substrate;

color filters formed in the second substrate, each of the color filters aligned with one of the pixel electrodes; and a liquid crystal layer disposed between the first and second substrates.

3. A liquid crystal display comprising:

a liquid crystal panel including a plurality of liquid crystal cells for controlling light transmission;

a data driving unit for providing data signals, voltages of the data signals being applied to the liquid crystal cells to control the light transmission;

a common electrode driving circuit for providing a common voltage signal to the liquid crystal panel; and a first signal driving circuit for providing a first signal to the liquid crystal panel, the first signal having the same frequency and amplitude as the common voltage signal, the first signal and the common voltage signal being out of phase with each other, the liquid crystal panel comprising:

a first substrate;

a plurality of gate lines and data lines disposed in the first substrate;

a plurality of switching devices formed in the first substrate, each of the switching devices being coupled to one of the gate lines and one of the data lines;

a plurality of pixel electrodes formed in the first substrate, each of the pixel electrodes being coupled with one of the switching devices;

a common electrode formed between two of the pixel electrodes;

a second substrate facing the first substrate;

color filters formed in the second substrate, each of the color filters aligned with one of the pixel electrodes;

a transparent electrode formed on an outer surface of the second substrate that does not face the first substrate; and a liquid crystal layer disposed between the first and second substrates.

4. A liquid crystal display comprising:

a liquid crystal panel including a plurality of liquid crystal cells for controlling light transmission;

a data driving unit for providing data signals, voltages of the data signals being applied to the liquid crystal cells to control the light transmission;

a common electrode driving circuit for providing a common voltage signal to the liquid crystal panel; and a first signal driving circuit for providing a first signal to the liquid crystal panel, the first signal having the same frequency and amplitude as the common voltage signal, the first signal and the common voltage signal being out of phase with each other, the liquid crystal panel comprising:

a first substrate;

a plurality of gate lines and data lines disposed in the first substrate;

a plurality of switching devices formed in the first substrate, each of the switching devices being coupled to one of the gate lines and one of the data lines;

a plurality of pixel electrodes formed in the first substrate, each of the pixel electrodes being coupled with one of the switching devices;

a second substrate facing the first substrate;

a common electrode formed on an inner surface of the second substrate that faces the first substrate;

color filters formed in the second substrate, each of the color filters aligned with one of the pixel electrodes;

a transparent electrode formed on an outer surface of the second substrate; and a liquid crystal layer disposed between the first and second substrates.

5. The liquid crystal display as claimed in claim 4, wherein, when a polarity of a voltage applied to the pixel electrodes which are provided in the respective liquid crystal cells is reversed, the common voltage, a polarity of which is reversed, is applied to the common electrode to be suitable the polarity of the voltage applied to the pixel electrodes.

* * * * *